US005174359A

United States Patent [19]

Nelson et al.

[11] Patent Number: 5,174,359

[45] Date of Patent: Dec. 29, 1992

[54] SAW GUIDE BEARING CASTING MACHINE

[76] Inventors: Charles R. Nelson; Charles Nelson, Jr., both of Highway 2, Old Town, Id. 83822; Mark A. Nelson, 308 Larch St., Priest River, Id. 83856

[21] Appl. No.: 843,860

[22] Filed: Feb. 27, 1992

[51] Int. Cl.[5] ..... B22D 29/08

[52] U.S. Cl. ..... 164/347; 164/404; 164/342

[58] Field of Search ..... 164/341, 342, 343, 344, 164/347, 404

[56] References Cited

U.S. PATENT DOCUMENTS

| | | | |
|---|---|---|---|
| 1,780,514 | 11/1930 | Bateman et al. | 164/347 |
| 2,301,819 | 11/1942 | Sambrook | 164/347 |
| 3,161,918 | 12/1964 | Zearbaugh | 164/347 |
| 3,507,012 | 4/1970 | Aoki | 164/341 |

*Primary Examiner*—Richard K. Seidel
*Assistant Examiner*—E. R. Puknys
*Attorney, Agent, or Firm*—Wells, St. John, Roberts, Gregory & Matkin

[57] ABSTRACT

A saw guide bearing casting machine includes a pair of mold plates selectively movable by a cylinder between a closed operative position defining a mold cavity for receiving molten babbitt material and forming material into a saw guide bearing. The first mold plate includes a flat planar portion of the mold cavity. The second mold plate includes the remainder of the mold cavity, for forming the sides and face portions of the bearing. The second late slides on guide rods while the first plate is held stationary. Ejection pins and hole forming plugs and studs are provided on the second plate. The ejection pins slide within the second plate and through a stationary stop plate. Abutments are mounted on the ejection pins on opposite sides of the stop plate. Inward abutments strike the stop plate as the second plate is retracted, to force the cast bearing to drop from the mold. Outward abutments strike the stop plate as the second plate is closed to position headed ends of the ejection pins into complimentary depressions in the second mold plate such that flat ends of the pins are coextensive with the adjacent surfaces of the mold cavity. The studs and plugs are axially adjustable, as in a removable section of the second plate to allow for selective adjustment of the bearing thickness.

18 Claims, 5 Drawing Sheets

5174359

SAW GUIDE BEARING CASTING MACHINE

TECHNICAL FIELD

The present invention relates to machines for casting saw guide bearings.

BACKGROUND OF THE INVENTION

Gang saws such as those used for cutting individual boards from a cant are separated by precise distances by spacers along the blade arbor. These spacers ensure that the central portions of the saw blades are maintained precisely at the desired spaced intervals. However, the outward perimeters of the blades must also maintain such precision spacing in order to minimize the kerf, and the consequent completed dimension of the cut lumber.

To maintain consistent, accurate separation between adjacent saws in a gang, saw guides are provided. Saw guides are typically formed of a bearing material mounted to a spacer body. The bearing material is typically formed of babbitt metal. The bearing plates are secured to the spacer bodies and include lubricant passages therein for receiving liquid lubricant under pressure to minimize friction against the bearing surfaces.

Even though such lubricant is used, the bearings will eventually wear and require replacement. For this purpose, saw guide casting machines have been provided to facilitate relatively automated casting of the babbitt bearings. Such machinery, in the past, has been relatively complex, inefficient and time consuming. A need has therefore remained for a saw guide babbitt bearing casting machine that will operate efficiently and quickly to facilitate consistent and accurate casting of saw guide babbitt bearings.

BRIEF DESCRIPTION OF THE DRAWINGS

One or more preferred embodiments of the invention are illustrated in the accompanying drawings, which are briefly described below.

FIG. 10 is an enlarged exploded perspective view of a second mold plate; and FIG. 11 is an enlarged fragmented sectional view of a stud taken along line 11 in FIG. 10 with a plug shown in dashed lines behind.

DETAILED DESCRIPTION OF THE PREFERRED EMBODIMENTS

This disclosure of the invention is submitted in furtherance of the constitutional purposes of the Patent Laws "to promote the progress of science and useful arts" (Article 1, Section 8).

Figure 6:
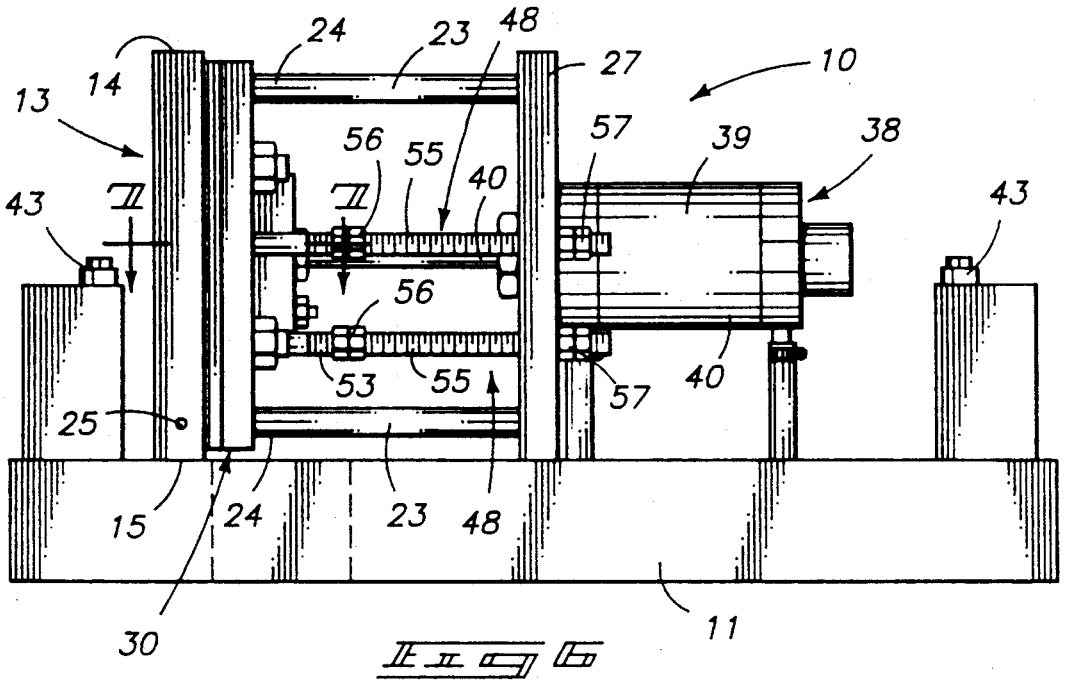
FIG. 6 is a view similar to FIG. 2 only showing the mold plates in a closed, operative position.

The present saw guide babbitt bearing casting machine is generally indicated in the drawings by the reference character 10. The machine 10 is intended for semi-automatic operation. That is to say, an operator is required to pour the babbitt material into the mold cavity, and to actuate the appropriate controls (described below) to cause the mold plates to shift relative to one another between an open second position (FIG. 2) and a closed first position (FIG. 6).

Figure 1:
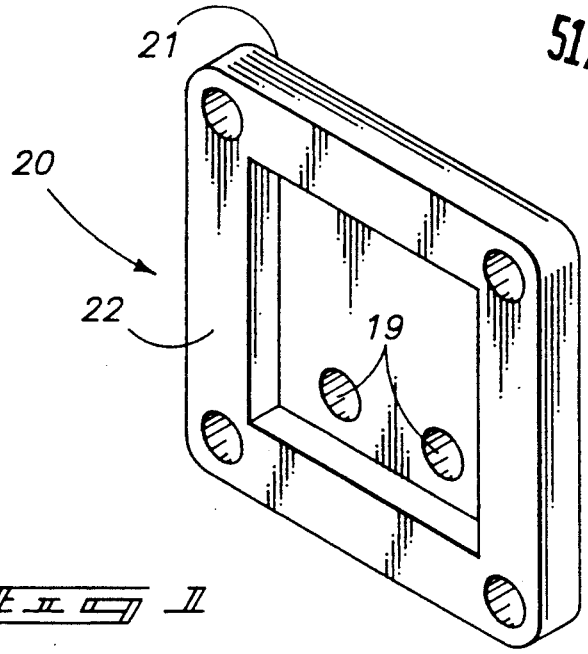
FIG. 1 is a perspective view of a single saw guide bearing of the nature produced by the present machine.

The machine 10 is utilized to produce saw guide bearing plates 20 (FIG. 1). These plates 20 are preferably formed of babbitt material consisting primarily of lead and zinc. The babbitt material is poured in molten form into a mold cavity produced by the machine 10 which includes features that enable separation of mold portions and stripping or ejection of the plate 20 from the machine.

The saw guide bearing plate 20 includes a flat back surface 21 and a formed front surface 22 with apertures extending therethrough to receive lubricant from the gang saw (not shown) to which the saw guides are mounted. The planar back flat surface 21 is received in flush engagement with a saw guide base or body (also not shown) so that the front surface 22 is exposed for engagement or to be positioned in close proximity to the gang saw blades.

It has been found that the saw guide bearing configuration 20 lends itself to particular considerations in the mold casting machine which will be described in more detail below.

The present machine 10 is mounted upon a rigid framework 11. This frame may be self supporting, or may be simply placed on a support surface such as a work bench or table. A first mold plate 13 is secured to the table 11 in a stationary position thereon. The first mold plate includes a top 14 and a bottom 15 that is affixed by conventional fastening method such as bolts (not shown) to the rigid frame 11.

Figure 7:
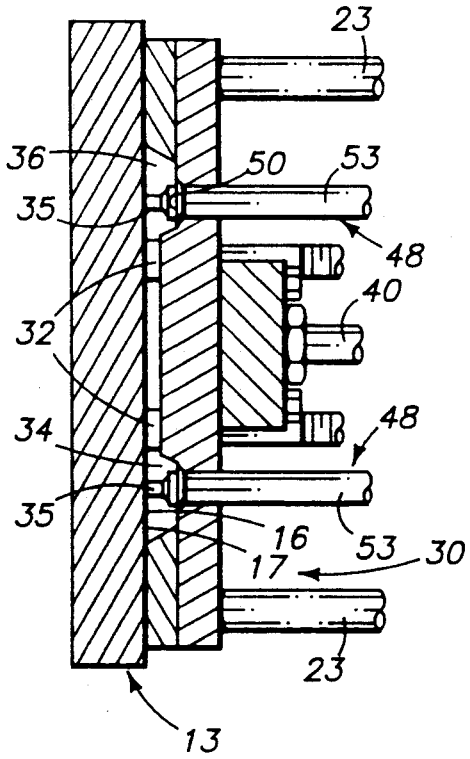
FIG. 7 is an enlarged fragmented sectional view taken substantially along line 7—7 in FIG. 6.

The first mold plate 13 is upright on the frame 11 and includes a planar, flat inward surface 16 that is utilized to form the flat back surface 21 of the mold. To this end, the flat inward surface 16 constitutes a mold section 17 of the saw guide cavity in those areas exposed to the cavity as shown in FIG. 7. The remainder of the flat inward surface 16 functions in conjunction with a second mold plate 30 to effectively seal the lower portions of the mold cavity against seepage or "flashing" of the molded babbitt metal.

Guide rods 23 extend outwardly from the first mold plate 13. In the preferred form, the guide rods 23 are horizontal and parallel to one another. They include ends 24 that may be releasably fixed to the first mold plate 13 by way of set screws 25 (FIGS. 2, 3) which facilitate removal of the guide rods from the machine and enable dismantling of the mold plates 15, 30 for repair or replacement.

The guide rods 23 extend to a stationary stop plate 27. The stop plate 27 is rigidly mounted to the frame 11 and is upright and substantially parallel to the first mold plate 13. The stationary stop plate 27 mounts remote ends 28 (FIG. 4) of the guide rods 23 by means of appropriate rod receiving apertures and set screws 29 which, like set screws 25, may be loosened to enable sliding motion of the guide rods 23.

Figure 9:
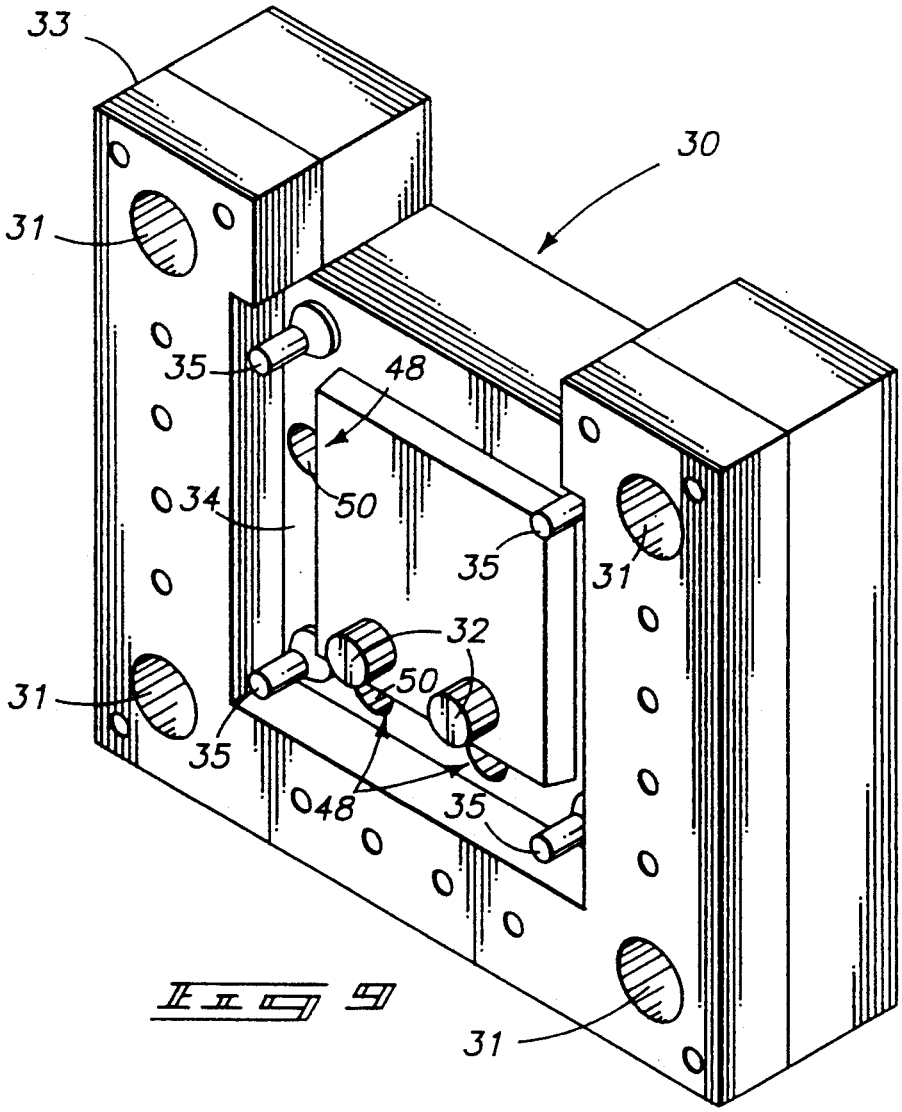
FIG. 9 is a perspective view of the second mold plate on the present machine.
Figure 2:
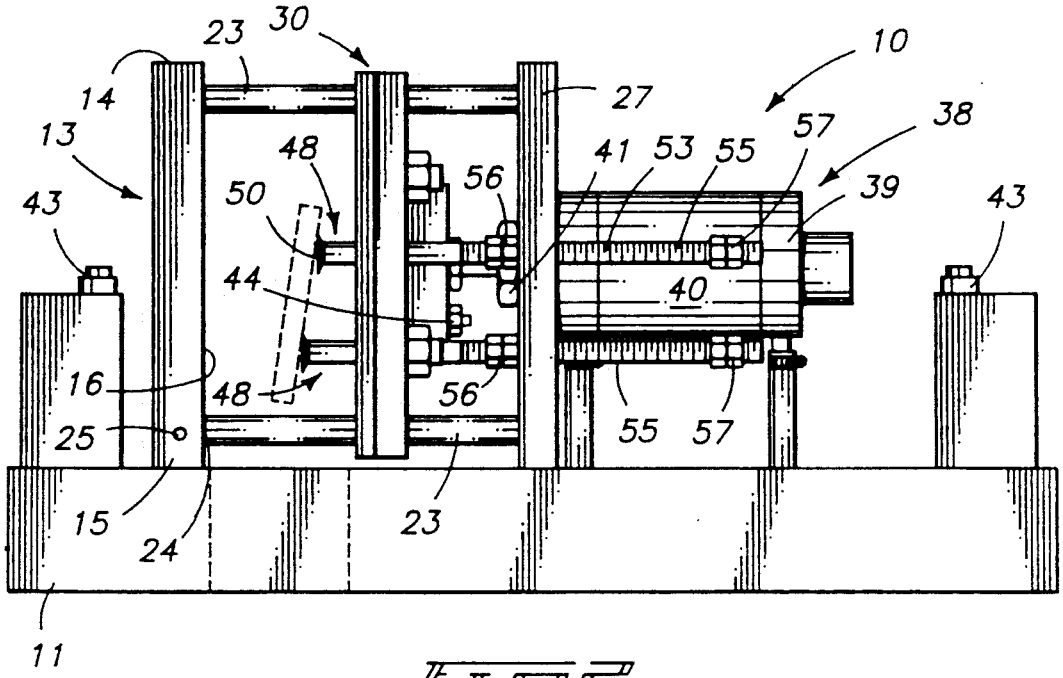
FIG. 2 is a side elevation view of the present machine with mold plates thereof in an open position.
Figure 3:
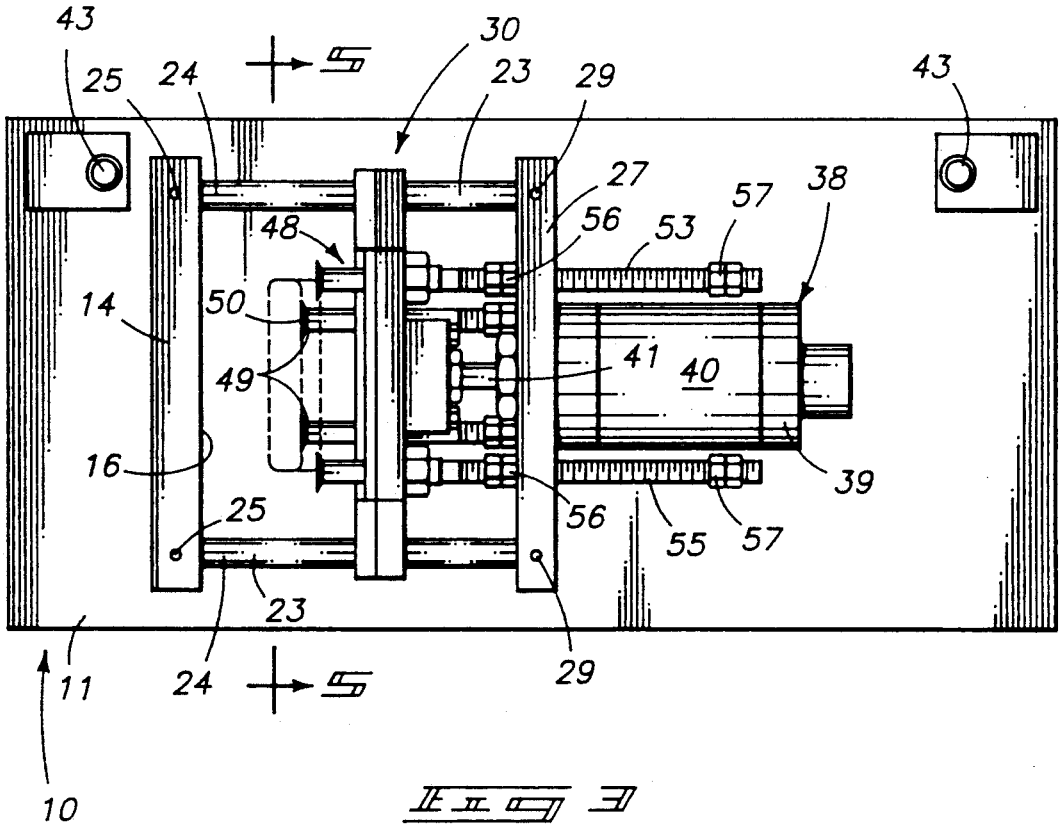
FIG. 3 is a top plan view of the machine also showing the mold plates open.

The second mold plate 30 is movably mounted to the guide rods 23 between mold plate 13 and stop plate 27. The guide rods 23 allow linear motion of the second mold plate 30 between an open condition as shown in FIGS. 2 and 3, and a closed condition as shown in FIGS. 6 and 7. The second mold plate 30 includes apertures 31 (FIGS. 9, 10) for slidably receiving the guide rods 23.

The second mold plate 30 includes a removable mold section 33. The mold section 33 and inward surfaces of plate 30 define the remaining section 34 of the mold cavity. The section 33 is removable in order to facilitate interchangeability with other mold sections (not shown) or to allow placement of shim stock to vary cavity depths to allow casting of bearing plates having selected thickness dimensions. Section 33 is releasably held to plate 30 by a number of bolts or other appropriate fasteners, one of which is shown in FIG. 10.

Adjustable studs 35 are mounted to plate 30 to extend into the mold cavity 36 (FIG. 7). The studs 36 form holes at the corners of the saw guide bearing plate 20 that receive mounting screws (not shown). The studs 35 extend through the second mold plate 30 and are secured by nuts 36 (FIG. 11) to the rearward second mold plate surface. The studs 35 are therefore axially movable to facilitate adjustment for placement of shims 26 (FIG. 10).

FIG. 11 indicates one of the studs 35, its associated threaded shank and a nut 36. The stud 35 is typical of the studs provided about the four corners of the mold cavity. Additionally, the arrangement shown in FIG. 11 is also common to plugs 32 used to form lubricant passages 19 (FIG. 1) in the bearing 20, which also must be adjustable in and outwardly in order to accommodate different bearing thicknesses. The dashed line in FIG. 11 is used to identify the end of a plug 32 which is otherwise similar to the studs 35, including threaded shanks and adjusting nuts 44 (FIG. 2).

The threaded shanks of the studs 35 and plugs 32 are received within complementary threaded apertures in the plate 30. The nuts 36, 44 are threadably received over the shanks in order to lock the studs 35 and plugs 32 in their adjusted axial positions.

The adjustment for the studs 35 and plugs 32 is provided to accommodate or shim stock 26 (FIG. 10) that may be placed between the plates 30 and 33 in order to adjust the thickness dimension of the saw guide bearing. Such shim stock 26 is commercially available in selected thicknesses and can be cut or shaped as desired. The configuration shown in FIG. 10 is simply exemplary of an assembly of three shim pieces to accommodate a desired thickness change. It should be understood, however, that other shim configurations may be as easily utilized, including prefabricated shim that may be used to expand the mold cavity to form standard thickness dimension bearings for standard number widths.

Means is provided as shown at 38 for moving the second mold plate 30 between open and closed conditions. Means 38 is preferably provided in the form of an air cylinder 39 mounted to the stationary stop plate 27. The cylinder 39 includes a cylinder body 40 that is secured to the plate, and a piston 41 that extends from the cylinder on an axis substantially parallel to the axes of the guide rods 23.

Figure 4:
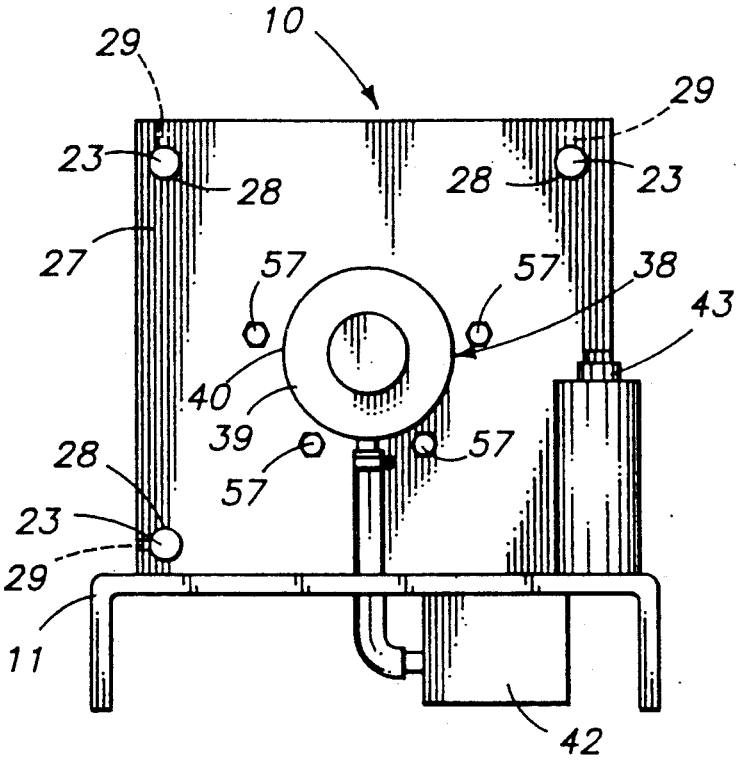
FIG. 4 is an end view as seen from the right in FIG. 2.
Figure 5:
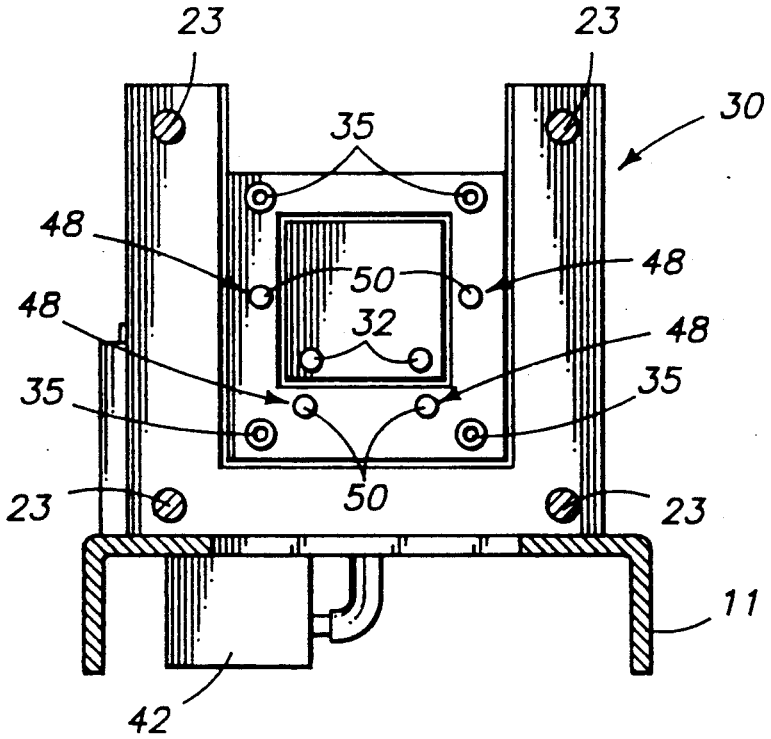
FIG. 5 is a sectional view taken substantially along line 5—5 in FIG. 3.

Pressurized air is supplied to the cylinder 39 through a conventional pressure system which is schematically illustrated at 42 (FIGS. 4, 5). Such system may be supplied from any commercially available air pressure system and, as such, will not be discussed in detail herein.

The cylinder 39 is operated by means of valving switches 43 provided on the frame. The switches 43 are also conventional and will not be discussed in detail herein. However, it is of interest to note that there are two switches 43 provided and that such switches 43 are separated along the length of the rigid frame 11. The distance between the switches is sufficient to require that the operator have both hands on the individual switches 43 in order to operate the machine. This is a safety precaution and will effectively prevent accidental operation of the cylinder 39 while one of the operator's hands is positioned between the mold plates.

Depression both valving switches 43 in unison activates the cylinder 39 to extend. The end of the piston 41 is mounted to the second plate 30 and, in response to extension of the cylinder 39, will move the plate from the open FIG. 2 orientation to the closed FIG. 6 position.

The present machines includes ejection pins 48. The pins 48 are slidably mounted to the second mold plate 30 to eject a molded bearing automatically upon retraction of the cylinder 39 and second mold plate 30 to the open condition.

The ejection pins 48 are provided in two sets, an upper set and a lower set. The pins are spaced about the mold cavity in order to most effectively remove the molded bearing plates from the second mold plate without bending or otherwise distorting the molded bearing.

Figure 8:
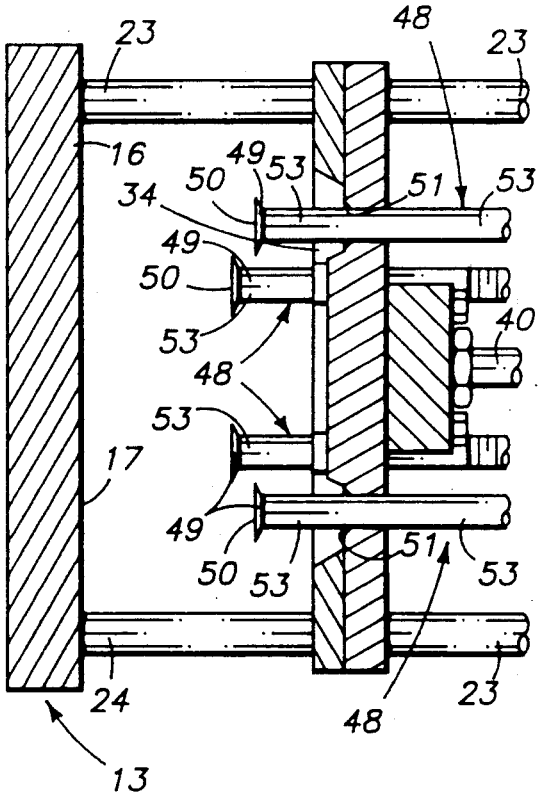
FIG. 8 is a view similar to FIG. 7 only showing the mold plates in an open condition.
Figure 3:
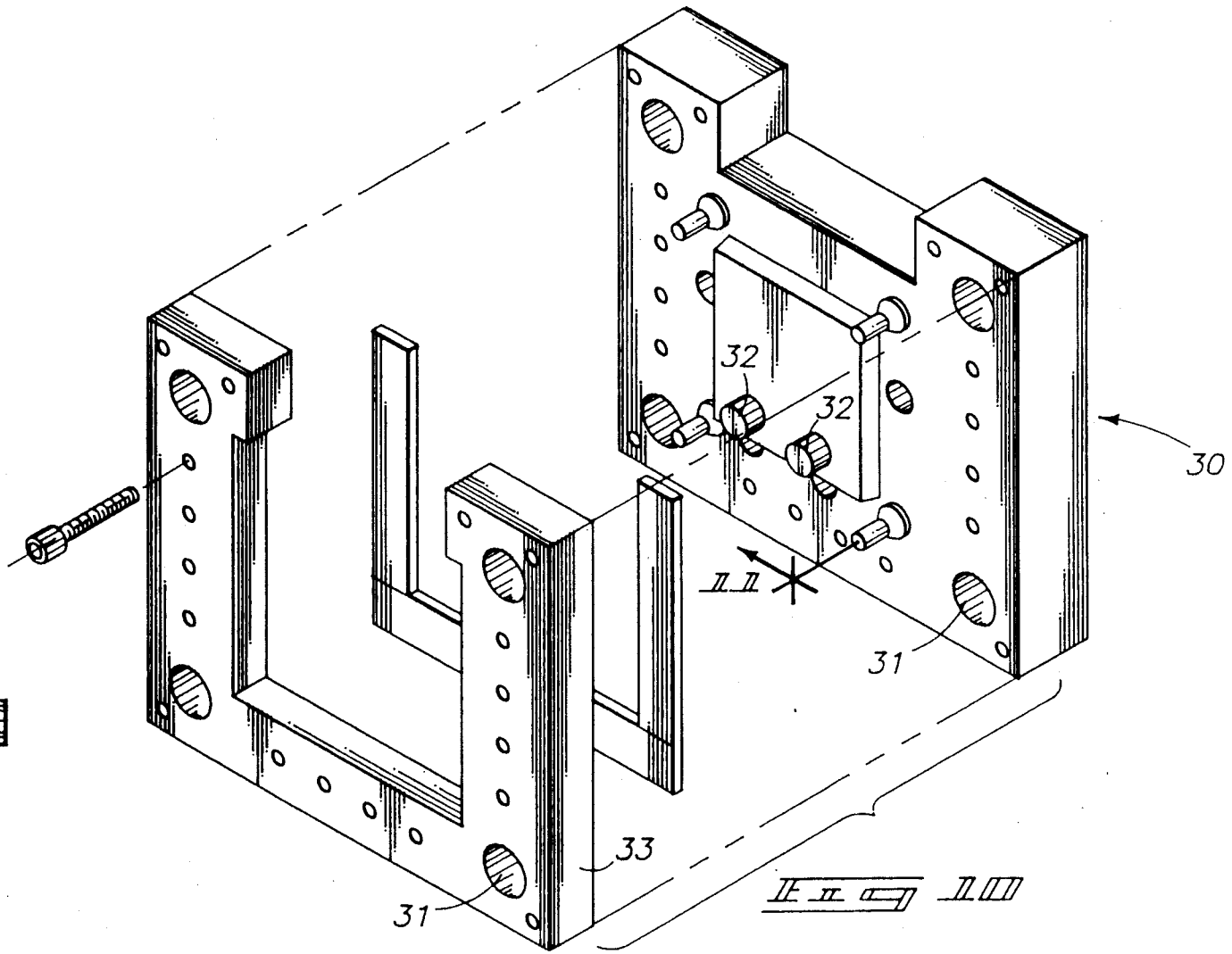
Figure 2:
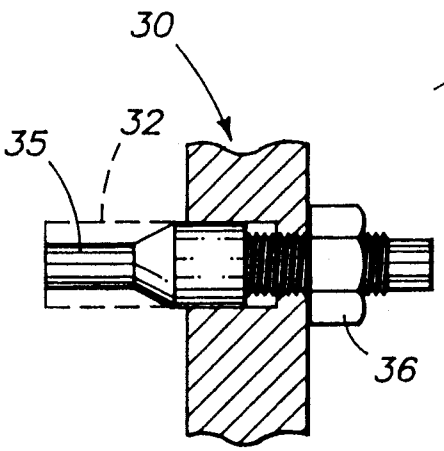

The ejection pins 48 include headed ends 49. These inward ends include surfaces 50 that are coextensive with the adjacent surfaces of the mold cavity 34 when withdrawn into complementary depressions 51 (FIG. 8) of the second mold plate 30. Thus, when retracted as shown in FIG. 7, the surfaces 50 form a portion of the mold surface and seal the mold cavity against seepage or flashing by the molten babbitt material. The pin end surfaces 50 therefore comprise a portion of the mold cavity when in this orientation.

The ejection pins include shafts 53 that extend rearwardly from the headed ends 49. The shafts 53 freely slide through complementary holes in plate 27. Rearward ends of the shafts 53 include threaded sections 55. These threaded sections mount inward abutment members in the form of nuts 56 and outward abutment members in the form of nuts 57 thereon. The inward abutment members 56 are situated inwardly of the stationary stop plate 27 and the outward abutment 57 are situated outwardly of the plate member 27 as shown in FIGS. 1, 3, and 6. The nuts 56, 57 are threadably positionable along the length of the threaded shaft sections in order to come into selective contact with the stop plate upon retraction and extension of the cylinder 39 and corresponding movement of the second mold plate 30.

In FIG. 2, the inward abutment members 56 have contacted the inwardly facing surface of stop plate 27 as the second plate 30 is retracted. The abutments 56 therefore stop further rearward progress of the ejection pins 48 and result in the pins remaining stationary as the plate is retracted. The headed ends thus engage and press the molded bearing outwardly as shown by the dashed lines in FIGS. 2 and 3.

The abutment nuts 56, 57 may be selectively adjusted so that one set of the headed ends 49 are spaced in relation to the stop plate 27 differently than the other set. This relationship is best shown in FIGS. 2 and 3. This is done to provide for extraction of the molded bearing at an angular orientation. The bearing is therefore progressively stripped from the mold cavity as opposed to being forcibly "popped" outwardly of the cavity. it has been found that angular extraction of the molded piece results in a consistent, uniform release without bending or distortion of the molded bearing.

Once extracted, the molded piece is free to drop through a lower ejection space 62 (dashed lines FIG. 2).

The outward abutment members 57 are positioned to come into contact with the rearward surface of the stationary stop plate 27 as the second mold plate 30 moves to the closed condition as shown in FIGS. 6 and 7. The nuts 57 are adjustable on the threaded shafts in order to selectively adjust the seating position of the headed ends within the complementary depressions 51. Such adjustment accommodates for placement of shims between the body of the second mold plate and the removable mold section 33.

Operation of the present invention will be described starting with the machine set in the open, FIG. 2 position.

FIGS. 2 and 3 illustrate the second mold plate 30 in the retracted, open condition. To shift the mold plate to the closed condition, the operator simply depresses both of the valving switches 43. The switches actuate the appropriate pneumatic air supply to extend the cylinder 39. The piston 41 then drives the second mold plate 30 to the closed condition. Here, the surfaces of the first and second mold plates 13, 30 that do not form portions of the mold cavity come into flush abutment, thereby sealing the lower perimeter of the mold. As the second mold plate 30 approaches the closed condition, the rearward or outward abutment members 57 engage the stop plate 27 and hold the headed ejection pin ends 49 in position for reception within the complementary depressions 51 of the second mold plate.

The abutment members 57 are so positioned that the head ends will be fully received in the depressions 51. The surfaces 50 will then be substantially coextensive with the mold surfaces as the first and second plates comes into contact. The two mold plates together form the mold cavity which is now ready to receive molten babbitt metal.

Molten metal may simply be ladled into the cavity, filling the cavity to the upper surface of the joined mold pieces. The combined upper open ends of the two plates therefor form an open sprue. Thus, the pour may be stopped as the top surface of the poured babbitt material meets the top ends of the plates. In providing such arrangement, the two mold sections do not require specific additional sprue sections. Rather, the sprue is simply comprised of the opening between the two mold plates 13, 30.

Molten babbitt material forms around the configuration determined by the flat inward surface 16, the cavity area 34 formed in the second mold plate 30, the studs 35 and plugs 32. The molten material is then allowed to cool and solidify.

After the molten material is allowed to cool, the operator again actuates the valving switches 43 to open the mold. In doing so, the cylinder retracts and pulls the second mold plate 30 away from the first mold plate. The cast bearing moves with the second mold member away from the flat smooth mold surface of the first plate.

As this happens, the ejection pins 48 also initially move rearwardly with the second plate. Then, the inward abutment members 56 come into contact with the stationary stop plate 27. The inertia or momentum built up by the opening second plate, coupled with the rearward force applied by the cylinder, assures continued rearward movement of the second plate while the ejection pins remain stationary, thereby pressing against the molded bearing and ejecting it from the mold cavity.

The spacing of the headed ejection pin ends 49 is such that the bottom headed ends first engage and press the molded bearing angularly from the second mold plate 30. Next, the upper set of pins engages and pushes the upward portion of the bearing from the mold cavity. The bearing drops in the angular orientation shown in FIG. 2 through the lower ejection space 62, thereby completing a cycle of operation.

Should the operator wish to change the thickness dimension of the bearing, such action may be accomplished quickly and simply by loosening the set screws holding the removable mold section 33 to the second mold plate 30. In doing so, section 33 may be spaced slightly outward of the body of the second mold plate by a distance sufficient to enable insertion of the shim pieces 26. Thus, there is no need to entirely remove the section 33 but simply to space it outwardly by a distance somewhat greater than the thickness of the shim stock. After the shims are inserted, and positioned, the section 33 may be tightened again against the second plate, thereby securing the shim stock in place around the perimeter of the mold cavity. The resulting thickness dimension of the bearing plate 20 is now increased by the thickness dimension of the shim stock.

In order to add thickness dimension to the plate 20, the studs 35 and the plugs 32 must also be axially adjusted. This is done simply by loosening the lock nuts 36 and by turning the threaded portion of the studs and plugs inwardly. This may be done using standard tools applied to the nut and the end portions of the threaded stud sections.

Preferably, adjustment of the studs 35 and plugs 32 are made with the mold plates in the closed position. The studs and plugs are turned until the end portions come into abutment with the flat first mold plate 13. Once such contact is made, the nuts 36 may be tightened to lock the studs and plugs into position. The machine is now ready to cast the selected sized plates, and operation takes place as described above.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. A saw guide bearing casting machine, comprising:

a frame;

a first mold plate on the frame forming a section of a saw guide mold cavity;

guide rods extending from the first mold plate;

a second mold plate movably mounted to the guide rods for motion between a first position against the first mold plate, and a second position away from the first mold plate;

wherein the second mold plate includes a remaining section of a saw guide mold cavity such that when the second mold plate is in the first position the cavity sections join to form a complete saw guide mold cavity;

means for moving the second mold plate to the first and second positions;

ejection pins slidably mounted to the second mold plate with headed inward ends receivable within complimentary depressions in the second mold plate and outward ends with spaced apart inward and outward abutment members thereon;

a stationary stop plate on the frame slidably receiving the outward ends of the ejection pins between the inward and outward abutment members thereof; and wherein the outward abutment members are situated on the ejection pins to engage the stationary stop plate and position the headed pin ends within the complimentary recesses in the second mold plate with the second mold plate in the first position, and wherein the inward abutment members are situated to engage the stationary stop plate and hold the headed pin ends stationary in saw guide ejection positions to engage and eject a molded saw guide from the separating mold plates as the second plate is moved to the second position.

2. A saw guide bearing casting machine as claimed by claim 1 wherein the guide rods are straight and parallel to guide the second mold plate in a linear path; and wherein the ejection pins are straight and parallel to the guide rods.

3. A saw guide bearing casting machine as claimed by claim 1 wherein the ejection pins include threaded shafts and wherein the abutment members are nuts threadably engaged on the threaded shafts.

4. A saw guide bearing casting machine as claimed by claim 1 wherein the inward abutment members are differently positioned in relation to the stationary stop plate to space the headed ends differently with respect to one another from the second mold member as the second mold member is moved to the second position.

5. A saw guide bearing casting machine as claimed by claim 1 wherein the ejection pins include threaded shafts and wherein the inward and outward abutment members are nuts threadably engaged on the threaded shafts; and the inward abutment members are differently positioned with respect to one another in relation to the stationary stop plate to space the headed ends differently from the second mold member as the second mold member is moved to the second position.

6. A saw guide bearing casting machine as claimed by claim 1 wherein the headed ends of the ejection pins include surfaces thereon that are substantially flush with adjacent mold cavity surfaces within the second mold plate in the first position thereof.

7. A saw guide bearing casting machine as claimed by claim 1 wherein the means for moving the second mold plate to the first and second positions is comprised of a single fluid cylinder having a piston shaft; the cylinder being mounted to the stationary stop plate and the second mold plate and operable to extend and retract to move the second mold plate between the first and second positions respectively.

8. A saw guide bearing casting machine as claimed by claim 1 wherein the mold plates are upright, and the second mold plate is movable substantially horizontally;

wherein the mold plates include upper ends defining sprue sections opening into the mold cavity sections, the sprue sections formed at the top edges of the mold plates to form a top edges of the cast bearing.

9. A saw guide bearing casting machine as claimed by claim 1 wherein the first mold plate is stationary on the frame.

10. A saw guide bearing casting machine as claimed by claim 1 wherein one of the mold plates includes a removable mold section.

11. A saw guide bearing casting machine as claimed by claim 1 wherein the second mold plate includes a removable mold section.

12. A saw guide bearing casting machine as claimed by claim 1 wherein the second mold plate includes;

axially adjustable studs thereon for forming openings through the cast bearing; and a removable mold section mounted thereon.

13. A saw guide bearing casting machine as claimed by claim 1 wherein the first mold section is stationary on the frame and includes a flat planar mold surface for forming a back surface of the bearing and;

wherein the second mold plate includes a removable mold section.

14. A saw guide bearing casting machine as claimed by claim 1 wherein the first mold plate is stationary on the frame and wherein the guide rods are parallel and extend from the stationary first mold plate to the stationary stop plate; and wherein the second mold plate is slidably mounted to the guide rods between the first mold plate and the stationary stop.

15. A saw guide bearing casting machine as claimed by claim 1 wherein the first mold plate is stationary on the frame and wherein the guide rods are parallel and extend from the stationary first mold plate to the stationary stop plate;

wherein the second mold plate is slidably mounted to the guide rods between the first mold plate and the stationary stop; and wherein the means for moving the second mold plate to the first and second positions is comprised of a single fluid cylinder having a piston shaft;

the cylinder being mounted to the stationary stop plate and the second mold plate and operable to extend and retract to move the second mold plate between the first and second positions respectively.

16. A casting machine, comprising:

a frame;

a first mold plate mounted stationary on the frame and forming a section of a mold cavity;

a plurality of parallel guide rods extending from the first mold plate to ends remote from the first mold plate;

stationary stop plate on the frame mounting the ends of the guide rods;

a second mold plate movably mounted to the guide rods between the first stationary mold plate and the stationary stop plate, for motion along the guide rods between a first position against the first mold plate, and a second position away from the first mold plate;

wherein the second mold plate includes a remaining section of a mold cavity such that when the second mold plate is in the first position the cavity sections join to form a complete mold cavity;

means for moving the second mold plate to the first and second positions;

ejection pins slidably mounted to the second mold plate with headed inward ends receivable within complimentary depressions in the second mold plate and outward ends with spaced apart inward and outward abutment members thereon;

inward surfaces of the ejection pins forming surfaces of the remaining mold section;

wherein the stationary stop plate on the frame slidably receives the outward ends of the ejection pins between the inward and outward abutment members thereof; and wherein the outward abutment members are situated on the ejection pins to engage the stationary stop plate and hold the headed pin ends within the complimentary recesses in the second mold plate with the second mold plate in the first position, and wherein the inward abutment members are situated to engage the stationary stop plate and hold the headed pin ends stationary in ejection positions between the separating mold plates as the second plate is moved to the second position.

17. A casting machine as claimed by claim 16 wherein the second mold plate includes;

axially adjustable studs thereon for forming openings through the cast bearings; and a removable mold section mounted thereon.

18. A casting machine as claimed by claim 17, wherein the first mold section includes a flat planar mold surface for forming a back surface of the bearing.

* * * * *